United States Patent [19]

Baillie et al.

[11] 3,953,318

[45] Apr. 27, 1976

[54] METHOD OF REDUCING SLUDGE ACCUMULATION FROM TAR SANDS HOT WATER PROCESS

[75] Inventors: Robert A. Baillie; James Van Dyck Fear, both of West Chester, Pa.

[73] Assignee: Great Canadian Oil Sands Limited, Toronto, Canada

[22] Filed: Oct. 17, 1974

[21] Appl. No.: 515,776

[52] U.S. Cl. ..... 208/11 LE

[51] Int. Cl.[2] ..... C10G 1/04

[58] Field of Search ..... 208/11; 210/44, 83, 210/73 OW

[56] References Cited

UNITED STATES PATENTS

| | | | |
|---|---|---|---|
| 3,392,833 | 7/1968 | Baillie | 208/11 |
| 3,502,565 | 3/1970 | Baillie | 208/11 |
| 3,526,585 | 9/1970 | Camp | 208/11 |

*Primary Examiner*—Delbert E. Gantz
*Assistant Examiner*—James W. Hellwege
*Attorney, Agent, or Firm*—Donald R. Johnson; J. Edward Hess; Richard P. Maloney

[57] ABSTRACT

A method for reducing the sludge layer in an effluent retention pond associated with hot water extraction of bitumen from tar sands comprising recycling sludge from the retention pond to aid in removing the aqueous effluent discharge from the extraction process and thereby effect a reduction of the volume of the sludge layer in the pond.

2 Claims, 1 Drawing Figure

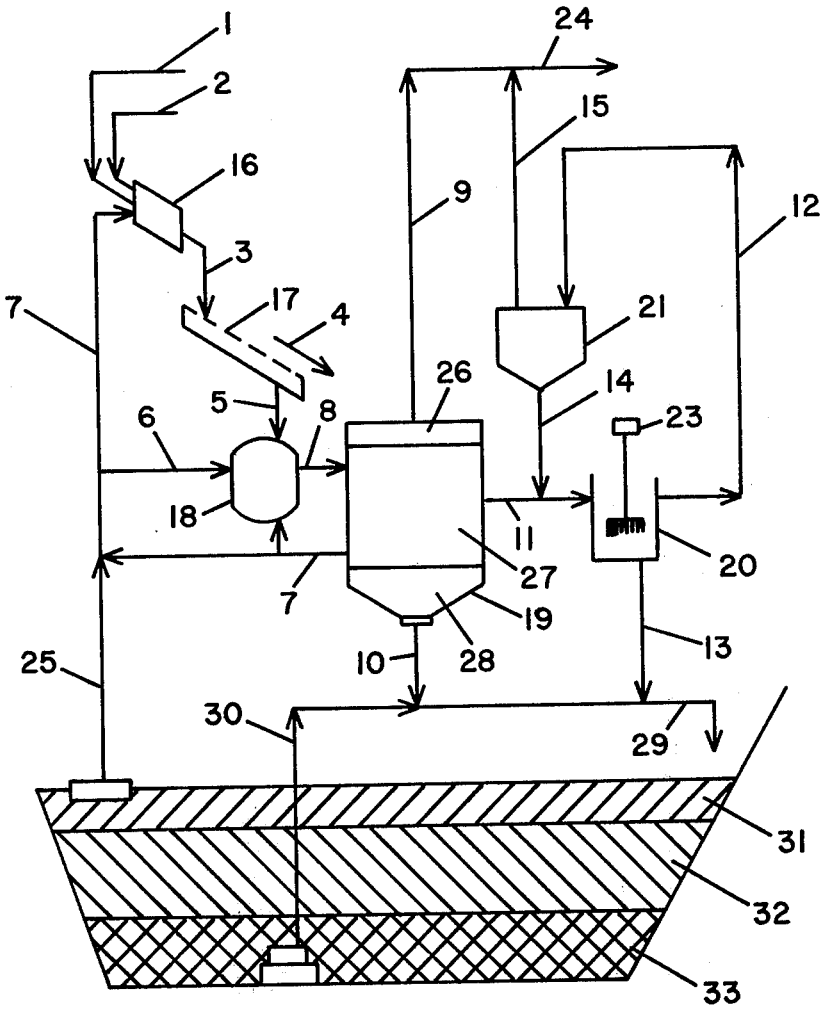
1
2
16
3
17
4
7
5
6
8
18
7
25
24
15
9
12
21
14
26
23
11
27
20
19
28
10
13
30
29
31
32
33

METHOD OF REDUCING SLUDGE ACCUMULATION FROM TAR SANDS HOT WATER PROCESS

BACKGROUND OF THE INVENTION

The present invention relates to an improvement in the hot water process of extracting bitumen from tar sands. This invention particularly relates to treatment of effluent discharge and treatment of water storage retention ponds used in retaining effluent discharge waste streams recovered from hot water extraction of bitumen from tar sands.

Tar sands which are also known as oil sands and bituminous sands are siliceous materials which are impregnated with a heavy petroleum. The largest and most important deposits of the sands are the Athabasca sands, found in northern Alberta, Canada. These sands underlay more than 13,000 square miles at a depth of 0 to 2000 feet. Total recoverable reserves after extraction and processing are estimated at more than 300 billion barrels—just equal to the world-wide reserves of conventional oil, 60 percent of which is in the Middle East. By way of contrast, the American Petroleum Institute estimated total United States oil reserves at the end of 1965 at 39.4 billion barrels.

The tar sands are primarily silica, having closely associated therewith an oil film which varies from about 5 percent to 21 percent by weight, with a typical content of 13 weight percent of the sand. The oil is quite viscous—6° to 8° API gravity—and contains typically 4.5 percent sulfur and 38 percent aromatics.

The sands contain, in addition to the oil and sand components, clay and silt in quantities of from 1 to 50 weight percent, more usually 10 to 30 percent. The sands also contain a small amount of water, in quantities of 1 to 10 percent by weight, in the form of a capsule around the sand grains.

Several basic extraction methods have been known for many years for the separation of oil from the sands. In the so called "cold water" method, the separation is accomplished by mixing the sands with a solvent capable of dissolving the bitumen constituent. The mixture is then introduced into a large volume of water, water with a surface agent added, or a solution of neutral salt in water, which salt is capable of acting as an electrolyte. The combined mass is then subjected to a pressure or gravity separation.

In the hot water method, as disclosed in Canadian Pat. No. 841,581 issued May 12, 1971, the bituminous sands are jetted with steam and mulled with a minor amount of hot water at temperatures of 170° to 190°F., and the resulting pulp is then dropped into a turbulent stream of circulating hot water and carried to a separation cell maintained at a temperature of about 185°F. In the separation cell, sand settles to the bottom as tailings and oil rises to the top in the form of a froth. An aqueous middlings layer comprising clay and silt and some oil is formed between these layers. This basic process may be combined with a scavenger step for further treatment of the middlings layer obtained from the primary separation step to recover additional amount of oil therefrom.

The middlings layer either as it is recovered from the primary process or as it is recovered after the scavenger step comprises water, clay and oil. The oil content is, of course, higher in middlings which have not undergone secondary scavenger steps.

Hereinafter in this specification, the term "effluent discharge" will be used to describe middlings material of deplete oil content which has undergone final treatment and which comprises clay dispersed in water, the sand tailings layer also containing some clay and bitumen and other discharged water-containing fractions which are not the primary products of the hot water process. The effluent discharge is removed from the process plant as a slurry of about 35 to 75, typically 45 percent, solids by weight. Included in the slurry is sand, silt, clay and small quantities of bitumen. In this specification, sand is siliceous material which will not pass a 325 mesh screen. Silt will pass 325 mesh but is larger than 2 microns. Clay is material smaller than 2 microns including some siliceous material of that size. Included in the slurry is sand, silt, clay and small quantities of bitumen ranging from about 0.5 to 2.0 weight percent of the total discharge.

Because the effluent contains oil emulsions, finely dispersed clay with poor settling characteristics and other contaminants, water pollution considerations prohibit discarding the effluent into rivers, lakes or other natural bodies of water. The disposal of the effluent discharge has therefore presented a problem. Currently, effluent discharge is stored in evaporation ponds which involve large space requirements and the construction of expensive enclosure dikes. A portion of the water in the effluent discharge is recycled back into the hot water extraction process as an economic measure to conserve both heat and water. However, experience has shown that the dispersed silt and clay content of the recycled water can reduce primary froth yield by increasing the viscosity of the middlings layer and retarding the upward settling of oil flecks. When this occurs, the smaller oil flecks and those that are more heavily laden with mineral matter stay suspended in the water of the separation cell and are removed from the cell with the middlings layer. Effluent discharge from the hot water process for extracting bitumen from tar sands contains a substantial amount of mineral matter some of which is colloidally dispersed in the effluent discharge and therefore does not settle very readily when stored in the retention pond. The lower layer of the retention pond can contain up to 50 percent dispersed mineral matter made up substantially of clay and silt and can contain up to 5 percent bitumen. This part of the pond water is normally referred to as sludge. This layer of the pond is generally not suitable for recycling to the hot water extraction process for the reason that its addition into the separation cell or the scavenger cell at the normal inlet means would raise the mineral content of the middlings of the cell to the extent that recovery of bitumen would be substantially reduced. Generally, the settling which does take place in the pond provides a body of water in which the concentration of mineral matter increases substantially from the surface of the pond to the bottom thereof. One such pond now in commercial use containing effluent discharge and having a surface area of about 1000 acres and an average depth of 40 feet can be characterized somewhat as follows:

a. From the surface of the pond to a depth of 15 feet, the mineral concentration which is primarily clay is found to be about 0.5 to 5.0 weight percent. This pond water can normally be recycled to a hot water extraction process without interfering with the extraction of bitumen from tar sands.

b. The layer of water in the pond between 15 and 25 feet from the surface contains between 6 and 15 percent mineral matter. This water if recycled in any appreciable extent in lieu of fresh water to the separation cell feed with fresh tar sands would increase the mineral content of the middlings portion of the cell to the point that little bitumen would be recovered.

c. Finally, the section of the pond between 25 feet and the bottom of the pond contains 16 to 50 percent mineral matter and is normally referred to as sludge.

Although all pond water is generally suitable for the process of the present invention, the effluent from the hot water extraction that is particularly suitable for use in this invention is that part of the effluent which is referred to as sludge.

DESCRIPTION OF THE INVENTION

The present invention comprises a process wherein the sludge layer from the retention pond as hereinabove defined is utilized as a carrier to aid in removing effluent discharge from a hot water process for extracting bitumen from tar sands. The benefits derived from the method of the present invention include: (*a*) more effective removal of the effluent discharge streams and (*b*) reduction of the sludge layer of a retention pond normally associated with the hot water extraction process thereby effecting improved efficiencies in fresh water usage.

One mode of operation of the present invention can be understood by referring to the FIGURE.

In the FIGURE, bituminous tar sands are fed into a hot water extraction system through line 1 where they first pass into mixing zone 16. Water and steam are introduced from 2 and mixed with sands. The total water so introduced is a minor amount based on the weight of the tar sands and generally is in the range of 10 to 45 percent by weight of the mixture. Enough steam is introduced to raise the temperature in the conditioning drum to within the range of 130° to 210°F. preferably above 170°F. Water added into the mixing zone can also be middlings or pond water recycled via line 7. An alkaline reagent can also be added to the mixing zone usually in the amount of from 0.1 to 3.0 pounds per ton of tar sand. The amount of such alkaline reagent preferably is regulated to maintain the pH of the middlings layer in separation zone 19 within the range of 7.5 to 9.0. The best results are obtained at a pH value of 8.0 to 8.5. The amount of alkaline reagent that needs to be added to maintain the pH value in the range of 7.5 to 9.0 can vary from time to time as the composition of the tar sands obtained from the mine site varies. The alkaline reagents normally used for this purpose are caustic soda, sodium carbonate or sodium silicate although any of the other alkaline reagents known for this application in the art can be used if desired.

The mixture from zone 16 can then be passed via line 3 to screen indicated at 17. The purpose of screen 17 is to remove from the pulp any debris such as rocks or oversized lumps of tar sands as indicated generally at 4. The pulp then passes via line 5 from screen 17 into sump 18 wherein it is diluted with additional water from line 6 which can be recycled from the pond surface via line 25 or fresh water from a fresh water source or can also be a mixture of any of these two or combined with middlings from separation zone 19 added via line 7. Addition of water now places the pulp in a pumpable condition so that it can be easily transferred into separation zone 19. Additional water wash can also be added to screen 17 to wash the pulp into sump 18 in place of the water added via line 6. In normal practice the total amount of water added to the tar sands pulp as liquid water and as steam prior to the separation step should be in the range of 0.2 to 3.0 pounds per pound of the tar sands. The water requirements for the separation zone, of course, are contingent upon the quantity of silt and clay which the tar sands contain as compared to the bitumen content of the tar sands. For example, when 15 percent by weight of the mineral matter of the tar sands has a particle size below 2 microns, the fresh water added generally can be about 0.3 to 0.5 pounds per pound of tar sands. On the other hand, when 30 percent mineral matter is below 2 microns in diameter generally a larger quantity such as 0.7 to 1.0 pounds of water per pound of tar sands is required. It is a general rule the amount of water needed within the process as fresh water increases as clay content relative to the bitumen content of the tar sands increases and to some extent with the silt content.

The tar sands slurry is transferred from sump 18 to separation zone 19 via line 8. In separation zone 19 the slurry mixture is agitated by conventional means and the contents of the separation zone normally separates into an upper bitumen froth layer as indicated by 26, a middlings layer indicated by 27 and sand tailings layer indicated by 28 in the FIGURE. From separation zone 19, the bitumen froth in the form of a primary bitumen froth is recovered via line 9. Middlings from the zone can be withdrawn for recycling via line 7 as previously disclosed and also middlings are withdrawn via line 11 and transferred into a secondary recovery zone known as a flotation scavenger zone 20. In the scavenger zone air is provided so that an air flotation operation can be conducted. Air is provided via aerator 23 at a locus where agitation of the middlings is being effected so that the air becomes dispersed in the middlings and forms small bubbles. Small bubbles combined with the bitumen aid in floating the bitumen to the surface of scavenger zone 20 wherein it is withdrawn via line 12 into froth settler zone 21 where again the froth is permitted to settle. The froth in zone 21 is recovered via line 15 from the top of the settler and combined in line 24 with the froth from line 9. The tailings containing mineral and water and some bitumen is withdrawn via line 14 and added to line 11 wherein it is recycled into flotation scavenger zone 20. The tailings from scavenger zone 20 are drawn via line 13 and combined with the tailings from the separation zone 19 which are withdrawn via line 10 both of which are combined in line 29. Recycle sludge from the pond is transferred into effluent discharge line 29 via line 30. The combined sludge and effluent discharge is thereafter returned to the pond.

The pond as shown in the FIGURE can be thought of as having three layers or stratum of mineral and bitumen dispersed in water. This description is characteristic of a pond storing the effluent discharge of a hot water process as herein above described. The upper layer 31 of the pond dependent on the mode of operation of the extraction process can contain 1 to 80 percent and often 5 to 40 percent of the pond volume and is uppermost in the stratum of the pond. This layer of the pond normally contains between 0.5 to 5.0 weight percent mineral matter generally in the form of fine clay less than 2 microns in size. The number 32 in the FIGURE denotes the middle layer of the pond which can contain 5 to 20 percent mineral matter including clay and silt dispersed colloidally. The lower layer of the pond 33 can be 40 percent of the volume of the pond which can contain up to 50 percent mineral matter in the form of clay and silt. This layer in the pond is commonly referred to as sludge and has not been suitable for use in any part of the hot water extraction process as disclosed above.

This lower sludge layer by the process of the present invention is pumped through line 30 into effluent discharge line 29.

As a part of the process of this invention the dispersion of minerals and bitumen in the recycle sludge composition is agitated and mixed with fresh effluent to provide an improved compaction of minerals in the sludge fraction of the stream. By mixing sludge with effluent discharge as disclosed in this invention, silt and clay particles which are in the recycle sludge fill the interstices between sand particles when the entire mixture is returned to the pond. The effect of this process is in part a replacement of the water which normally fills the sand bank interstices with clay and silt thereby effecting a release of more water and a compaction of mineral matter in the pond.

Thus the over-all effect achieved is the reduction of the proportional volume of the sludge layer in the pond. With a reduction of the volume of the sludge layer in the pond, more of the pond water becomes suitable for recycling because of the over-all improved settling characteristics of the pond. The end result of the process is the lessening of demand for fresh water in the hot water extraction process for recovering bitumen from tar sands which is intimately associated with the pond.

Thus the present invention is an improvement in the hot water process for recovering bitumen from tar sands comprising in an extraction zone forming a mixture of tar sands and water; passing said mixture into a separation zone to form an upper bitumen froth layer, a middlings layer comprising water, bitumen and mineral matter and a sand tailings layer comprising water, bitumen and mineral matter, the improvement which comprises: (*a*) withdrawing said tailings layer from said extraction zone; (*b*) thereafter admixing said tailings layer with sludge recovered from an effluent discharge retention pond and thereafter returning the sludge-effluent discharge mixture to the retention pond.

The invention claimed is:

1. An improved method for transferring effluent discharge recovered from hot water extraction of bitumen from tar sands to a retention pond comprising:

a. withdrawing pond sludge from said retention pond;

b. admixing said pond sludge with said effluent discharge; and c. transferring said mixture to the retention pond.

2. In a hot water process for extracting bitumen from bituminous tar sands wherein waste hot water from the process is stored in a retention pond said process comprising; forming a mixture of tar sands and hot water; passing said mixture into an extraction zone to form an upper bitumen froth layer, a middlings layers and a sand tailings layer containing bitumen, water and mineral matter and wherein the sand tailings layer is discharged to the retention pond, the improvement which comprises:

a. withdrawing the tailings layer from the extraction zone, b. admixing said withdrawn tailings layer with pond sludge withdrawn from a retention pond and c. discharging said mixture to said retention pond.

* * * * *